United States Patent [19]

Sarazen

[11] Patent Number: 4,911,456

[45] Date of Patent: Mar. 27, 1990

[54] WHEEL ASSEMBLY

[76] Inventor: Philip Sarazen, 162 Henderson Avenue, Ottawa, Ontario, K1N 7P6, Canada

[21] Appl. No.: 233,766

[22] Filed: Aug. 19, 1988

Related U.S. Application Data

[63] Continuation of Ser. No. 7,118, Jan. 27, 1987, abandoned.

[51] Int. Cl.[4] ..... A63C 17/14

[52] U.S. Cl. ..... 280/11.2; 280/11.28; 280/87.042

[58] Field of Search ..... 280/11.2, 11.22, 11.27, 280/11.28, 11.33, 844, 87.041, 87.042, 87.043; 188/2 R, 22, 74

[56] References Cited

U.S. PATENT DOCUMENTS

| | | | |
|---|---|---|---|
| 333,751 | 1/1886 | Harris, Jr. | 280/11.2 |
| 968,427 | 8/1910 | Simon | 280/11.2 |
| 1,026,712 | 5/1912 | Simon | 280/11.2 |
| 2,139,699 | 12/1938 | Segal | 280/11.2 |
| 2,173,716 | 9/1939 | Gurleay | 280/11.2 |
| 2,356,736 | 8/1944 | Blaes | 280/11.2 |
| 4,062,557 | 12/1977 | Roden | 280/11.27 |
| 4,337,961 | 7/1982 | Covert et al. | 280/11.1 ET |
| 4,453,726 | 6/1984 | Ziegler | 280/11.2 |

FOREIGN PATENT DOCUMENTS

| | | | |
|---|---|---|---|
| 182072 | 10/1954 | Austria | 280/11.2 |
| 2816281 | 10/1978 | Fed. Rep. of Germany | 280/11.2 |
| 2721927 | 11/1978 | Fed. Rep. of Germany | 280/11.2 |
| 62701 | 10/1948 | Netherlands | 280/11.2 |
| 82445 | 2/1920 | Switzerland | 280/11.2 |
| 1440 | of 1876 | United Kingdom | 280/11.2 |

*Primary Examiner*—Charles A. Marmor
*Assistant Examiner*—Brian L. Johnson
*Attorney, Agent, or Firm*—Burke-Robertson

[57] ABSTRACT

There is provided a new and useful wheel assembly incorporating a brake mechanism for mounting on the frame or base of a skateboard or a roller skate comprising a truck for attachment to a roller skate or skateboard, a first axle secured on the truck, a pair of wheel supports mounted on the first axle for rotation relative to the first axle, a first wheel mount on the wheel supports forward of the first axle for carrying a pair of forward wheels mounted thereon, a second wheel mount on the wheel supports rearward of the first axle and having at least one rearward wheel mounted thereon; and frictional brakes fixed to the first axle, the brakes positioned such that a predetermined amount of rotation of the wheel supports relative to the first axle will bring the brakes into contact with at least one of the wheels.

7 Claims, 1 Drawing Sheet

WHEEL ASSEMBLY

This application is a continuation of my co-pending Application Ser. No. 007,118, filed Jan. 27, 1987, and is now abandoned.

This invention relates to wheel assemblies of the type useful on roller skates and skateboards and having associated brake means.

BACKGROUND OF THE INVENTION

Controlled braking has always been a problem for those who are not very skilled at the art of roller skating or skateboarding. As such roller skating and skateboarding have their dangerous moments on busy streets.

The new invention addresses this problem with a simple design, free of complex mechanisms. The assembly can be retrofit onto old skates or skateboards making use of all the old parts or it can be pre-assembled and used to replace the old assemblies. The action used by the skater to apply the brakes follows a similar braking style to the traditional skate and skateboard brake.

A "5th wheel"-type assembly, when applied to the present context, as in other wheeled vehicles with front wheel brakes, provides for stronger braking. All other braking systems on roller skates and skateboards having the weight ahead of the braking and as such braking is a drag-action.

PRIOR ART

Prior art proposals for roller skate brakes include a toe or heel friction brake: U.S. Pat. No. 2,356,736 of Blaes; a wheel-type brake mechanism described in Segal, Pat. No. 2,139,699. Segal shows a series of lever mechanisms and brake pads activated by the change in position of the rear pad or wheel relative to the wheel to be acted upon the brake.

SUMMARY OF THE INVENTION

It has now been discovered that a "5th wheel"-type assembly; that is, an assembly having a pair of axles or the like wheel mounting means ultimately joined to a vehicle by a single axle, can be applied with advantage to roller skates, skateboards or the like.

There is thus provided a wheel assembly adapted to be mounted on the frame or base of a skateboard or a roller skate comprising a truck adapted to be attached to a roller skate or skateboard, a first axle secured on the truck, a pair of wheel supports mounted on the first axle for rotation relative to the first axle, a first wheel mounting means mounted on the wheel supports forward of the first axle and adapted to carry a pair of forward wheels mounted thereon, a second wheel mounting means mounted on the wheel supports rearward of the first axle and having at least one rearward wheel mounted thereon; and frictional brake means fixed to one of (a) the first axle (b) the truck or (c) the frame or base, the brake means positioned such that a predetermined amount of rotation of the wheel supports relative to the first axle will bring the brake means into contact with at least one of (a) the wheels or (b) at least one of the first and second wheel mounting means.

BRIEF DESCRIPTION OF THE DRAWINGS

In drawings which illustrate embodiments of the invention.

Figure 1:
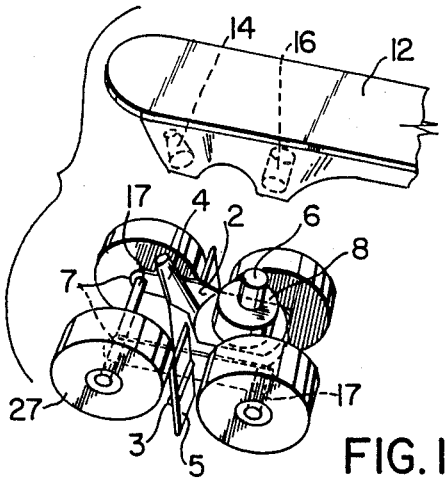
FIG. 1 is a perspective view of an embodiment of the brake assembly and the back half of the roller skate frame.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF PREFERRED EMBODIMENTS

In the following description, similar features in the drawings have been given similar reference numerals.

In FIG. 1 the traditional two wheel truck 2, is positioned below the skate frame 12. The rear support mount 4 of the truck 2 is fitted into a hole 14 of the base 12. Bolt 6, which attaches the rubber discs 8 to the truck 2 is fitted in threaded hole 16. The 5th wheel or first axle 3 is attached to the truck. Brake pads 5 are attached to the axle 3. The dual wheel support 7 is attached to the axle between the pad 5 and the truck 2. The axle 3 is free to rotate on the dual wheel supports, the axle 3 is positioned between the two wheel axles 17. Axles 17 are attached to the dual wheel supports 7 and wheels 27 are attached to the axles 17.

Figure 2:
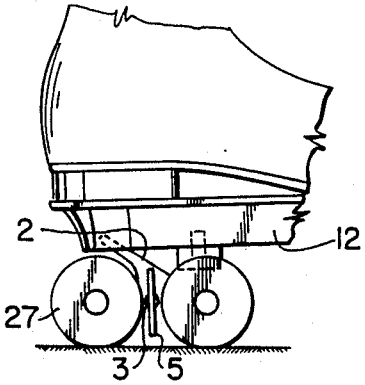
FIG. 2 is a side view of an embodiment of the brake assembly when not engaged.

FIG. 2 shows the truck 2 attached to the rear or heel portion of the skate. When the skate frame 12 is parallel to the ground the pads 5 do not touch the wheels 27.

Figure 3:
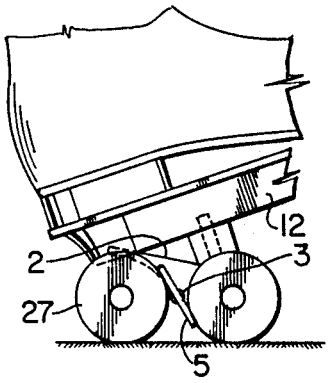
FIG. 3 is a side view of an embodiment of the brake assembly when engaged.

In FIG. 3 when the toe of the skate is lifted off the ground and the rear 5th wheel assembly remains on the ground, the 5th wheel axle 3 is forced to rotate counter clockwise. This forces the pads 5 against the wheels 27.

Figure 4:
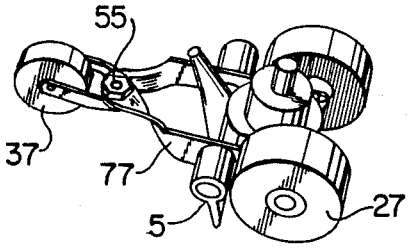
FIG. 4 is a perspective view of an embodiment of the brake assembly with a caster replacing the rear wheels.

In FIG. 4 the modified wheel supports 77 are joined at the rear by a bolt and nut 55 which also holds the caster 37. The modified brakes 5 brake the front wheels 27 only. The advantage of this design is to reduce friction. Braking power will be somewhat reduced.

Again while not shown in the drawings a spring could be attached between the 5th wheel assembly, and modifications thereof, and the skate base. This addition would provide for greater control, and help in dealing with curbs, particularly with skate boards.

Thus it is apparent that there has been provided in accordance with the invention a wheel assembly that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A wheel assembly adapting to be mounted on the frame or base of a skateboard or a roller skate comprising:

a truck adapted to be attached to a roller skate or skateboard;

a first axle secured on said truck;

a pair of wheel supports mounted on said first axle for rotation relative to said first axle;

a first wheel mounting means mounted on said wheel supports forward of said first axle and adapted to carry a pair of forward wheels mounted thereon;

a second wheel mounting means mounted on said wheel supports rearward of said first axle and having at least one rearward wheel mounted thereon; and frictional brake means fixed to said first axle said brake means positioned such that a predetermined amount of rotation of said wheel supports relative to said first axle will bring said brake means into contact with at least one of said wheels.

2. The wheel assembly of claim 1 wherein said first wheel mounting means comprises a forward axle mounted on said wheel support means.

3. The wheel assembly of claim 2 wherein said brake means comprises at least one brake pad acting on at least one of said forward wheels.

4. The wheel assembly of claim 3 wherein said brake means comprises brake pads acting on said two forward wheels.

5. The wheel assembly of claim 2 wherein said second wheel mounting means comprises a rearward axle mounted on said wheel support means and adapted to carry a pair of rearward wheels.

6. The wheel assembly of claim 5 wherein said brake means comprises at least one brake pad acting on at least one of said forward wheels and at least one brake pad acting on at least one of said rearward wheels.

7. The wheel assembly of claim 6 wherein said brake means comprises four said pads, one acting on each of said wheels.

* * * * *